US005568173A

United States Patent [19]

Leenders et al.

[11] Patent Number: 5,568,173

[45] Date of Patent: Oct. 22, 1996

[54] INK JET PRINTING METHOD

[75] Inventors: Luc Leenders, Herentals; Herman Remmerie, Edegem; Carlo Uyttendaele, Berchem, all of Belgium

[73] Assignee: Agfa-Gevaert, N.V., Mortsel, Belgium

[21] Appl. No.: 295,058

[22] Filed: Aug. 26, 1994

[30] Foreign Application Priority Data

| | | | |
|---|---|---|---|
| Sep. 7, 1993 | [EP] | European Pat. Off. | 93202599 |
| Dec. 29, 1993 | [EP] | European Pat. Off. | 93203720 |

[51] Int. Cl.[6] ..... B41J 2/205; B41M 5/20

[52] U.S. Cl. ..... 347/96; 347/102; 347/105; 106/20 D

[58] Field of Search ..... 347/96, 102, 105; 106/20 D

[56] References Cited

U.S. PATENT DOCUMENTS

| | | | |
|---|---|---|---|
| 4,046,074 | 9/1977 | Hochberg et al. | 347/96 |
| 4,554,181 | 11/1985 | Cousin et al. | 347/106 |
| 5,380,769 | 1/1995 | Titterington et al. | 347/102 |

FOREIGN PATENT DOCUMENTS

| | | | |
|---|---|---|---|
| 56-11887 | 7/1981 | Japan | 347/96 |

OTHER PUBLICATIONS

Sambucetti, et al.; Chemical Mist Printing; IBM Technical Disclosure Bulletin; pp. 5423–5424, May 1978.

*Primary Examiner*—Valerie A. Lund
*Attorney, Agent, or Firm*—Breiner & Breiner

[57] ABSTRACT

An ink jet printing method is provided which method comprises the steps of:

(1) image-wise protecting by means of an ink jet a liquid, called ink, in the form of droplets onto a receiving material containing at least one reagent A that with at least one reagent B contained in the ink droplets is capable of forming by color reaction a colored product, and (2) optionally uniformly heating said receiving material and/or uniformly exposing it to chemically active electromagnetic radiation during and/or after the deposition of said ink on said receiving material to start or enhance said color reaction, characterized in that from separate ink jets ink of different concentrations of said at least one reagent B or inks containing separately reagents A or B in different concentration is (are) deposited image-wise onto said receiving material containing said at least one reagent A.

28 Claims, No Drawings

INK JET PRINTING METHOD

DESCRIPTION

1. Field of the Invention

The present invention relates to an ink jet recording method.

2. Background of the Invention

For many years printing proceeds with letterpress, gravure (intaglio) or planographic (lithographic) printing machines wherein a printing ink receptor, usually paper makes direct contact with an inked printing form [ref. e.g. Printing Technology by J. Michael Adams et al.—Delmar Publishers Inc. (1988)].

Nowadays other printing processes, so-called non-impact printing processes have found application, e.g. electrostatographic printing, and ink jet printing (ref. e.g. "Principles of Non-Impact Printing" by Jerome L. Johnson (3986)—Palatino Press—Irvine Calif., 92715 U.S.A.).

In ink-jet technology, tiny drops of ink fluid are projected directly onto an ink-receptor surface. The placement of each drop on the printing substrate is controlled electronically. Printing is accomplished by moving the printing head across an ink-receptor member (sheet or web) Or vice versa.

A survey of different ink jet printing systems is given e.g. in the already mentioned book "Principles of Non Impact Printing" and in "Imaging and Information Storage Technology" Edited by Wolfgang Gerhartz, Weinheim—New York—Basel—Cambridge (1992).

Ink jet printing systems may be classified into two groups according to whether the ink drops are deflected or not..

In continuous ink pet printing a stream of ink droplets is modulated by deflection forces (e.g. electrostatic forces after charging the ink droplets) to deposit the ink image-wise on an ink-receptor element (see e.g. U.S. Pat. No. 4,901,088).

In a particular continuous ink jet printing system ink is sprayed under pressure through a tiny glass nozzle about 10 microns in diameter. Although the ink emerges in a continuous stream traveling at about 60 meters per second, it quickly breaks into droplets under the influence of surface tension. Piezoelectric vibration in the megahertz range applied to the wall of the glass channel conducting the ink induces the formation of about one million droplets per second each drop having a diameter of about 30 microns.

In impulse ink jet printing ink, also called drop-on-demand ink jet printing, droplets are produced pulsewise and travel to the receptor material normally without further modification of their path.

According to one embodiment impulse droplet formation is based on electro-mechanical (piezo-electric) displacement of ink through a nozzle (see e.g. U.S. Pat. Nos. 4,879,568 and 4,887,100 and EP-A 0 339 926 and 0 340 960).

According to another embodiment the displacement forces are thermal as is the case in the bubble jet printer (see for both systems said already mentioned book "Principles of Non-Impact Printing", pages 259–262), and for the "bubble jet printer" in particular U.S. Pat. No. 4,914,736.

As described in Journal of Imaging Technology, Vol. 15, Number 3, June 1989 by C. H. Hertz and B. A. Samuelson in their article "Ink Jet Printing of High Quality Color Images", p. 141, 20–40—relating to continuous ink jet printing—several drops of ink have to be applied to each pixel (elementary picture element) to ensure maximum color density within a commercially acceptable writing time.

In drop-on-demand ink jet operating at kHz frequency in the formation of the ink drops, a single droplet of ink is deposited per pixel in order to not surpass an acceptable writing time for a full print; so in commercial practice no ink drops are deposited in superposition, and as a consequence thereof normally no optical reflection densities of more than 1.5 on opaque light-reflecting paper can be obtained therewith owing to the smallmass of each colored ink droplet and the limited concentration of colorant therein.

It would be a major improvement if inkjet printing could be used for producing images with increased optical density, say of more than 2.5 without droplet-superposition, or the number of superposed droplets could be reduced and yet high optical densities could be obtained within shorter writing times.

In IBM Technical Disclosure Bulletin Vol. 23 No. 4 Sep. 1980, W. T. Pimbley describes under the title "Leuco Dye System for Ink Jet Printing" what could be called reactive ink jet printing. The applied ink contains leuco or vat dyes. Such dyes convert to their permanent form when oxidized. Accordingly, the record medium is first coated or impregnated with an oxidizing agent. Upon combining with the oxidant, the dyes convert to their permanent form, becoming insoluble and having high tinctorial strength and excellent archival properties, such as water fastness and light fastness. However, as in direct thermal recording materials based on the use of leuco dyes no optical densities higher than 2 can be obtained therewith, certainly not within a short writing time.

Much higher densities (>3) are obtainable with an ink jet recording method described in unpublished European patent application No. 93202599.2, said method comprising the steps of:

(1) image-wise projecting liquid, called ink, in the form of droplets onto a receiving material containing according to a first mode at least one substantially light-insensitive organic silver salt and said ink contains a reducing agent, or according to a second mode said receiving material contains said reducing agent and the ink contains said silver salt, and (2) optionally heating said receiving material during and/or after the deposition of said ink on said receiving material to start or enhance reduction of said silver salt forming thereby an image-wise deposit of silver metal in said receiving material.

The problem of getting high density images has been solved by said method but there still remained the problem of producing images having sufficient grades of gray necessary for correctly reproducing continuous tone originals.

In reproducing continuous tone originals by classical printing techniques the image information is translated in a number of dots which technique is called halftoning by screening.

In a first mode halftoning by screening is obtained by translating the continuous tone image in an array of dots of different size. A second halftoning technique is based on dot-density modulation at constant dot size. A third halftoning technique is based on dot construction via individual pixels. In the latter case in the formation of one dot the pixels may be distributed stochastically (forming a so-called dispersed dot) or are joining each other (clustered) in the dot cell in a certain geometric pattern.

Dithering and error diffusion are the two most applied digital halftone approaches (ref. Journal of Electronic Imaging 2(1), 62–66 (January 1993). Error diffusion was introduced by Floyd and Steinberg in "An adaptive algorithm for spatial gray-scale"—Proc. SID 17(2), 75–77 (1976). Error diffusion compensates for any error in the gray tone of an individual cell by modifying the gray tone of adjacent pixels so that collectively the pixels display the correct tone.

By "dithering" is meant that halftone cells, called halftone dots, are divided into a pattern formed by tiny spots (pixels) arranged in different number and geometrically different configuration in the dot area also called cell, to simulate a more or less continuously varying density, since the group of tiny spots that partially fill the area of each cell correspond with a certain percent of gray.

The needed number of distinct gray steps in a copy having continuous tone appearance depends on the eye's ability to distinguish closely spaced grays. It is found that the human eye at normal reading distance can detect a reflectance modulation of about 0.5% at a spatial frequency near 1 cycle/nun. The inverse of this just perceptible modulation has been interpreted as the maximum number of gray steps that the eye can perceive. A rule of thumb in the printing industry is that an acceptable continuous tone picture should contain at least 64 gradations (gray steps). This translates into 6 bits of data for creating the halftone cells. For good printing quality, 100 or more steps are desired. An 8-bit data set can produce a gray scale with 256 gradations which is preferred for images serving in medical diagnosis.

In a binary printer, the maximum number of output gray levels is limited to the number of spots per halftone cell (p), plus 1. Thus for a typical 8 by 4 rectangular halftone cell, p+1=33 output gray steps. Halftone frequencies are expressed as a number of halftone cells per linear unit e.g. inch. Higher halftone frequencies have fewer spots per cell and therefore produce fewer gray steps. This is the fundamental limitation of binary printers [ref. U.S. Pat. No. 4,868,587 and under the heading "Dithering", p. 9 in the Handbook of Desktop Scanners—A Complete Guide to Low-Cost Scanners for Desktop Publishing, 2nd. ed. (1988) published by "micropublishing Report", 21150 Hawthorne Blvd., Suite 104, Torrance, Calif. 90503. Editor/Publisher: James Cavuoto], The dithering process requires complicated driver circuits. In binary (digital) operated electrophotographic systems in order to get around the problem of producing a multiplicity of pixels of equal density in one picture cell (halftone dot) a "multilevel" laser exposure source is used to expose pixels at more than one level of exposure. Operating that way a substantially greater number of unique halftone cells is produced and consequently a larger scale of continuous tone reproduction is obtained as explained in the above mentioned U.S. Pat. No. 4,868,587.

Ink jet printing, and certainly drop-on-demand ink jet printing, is also a binary operated printing system which shows the above explained limitations in gray shade reproduction of binary printers. Enlarged gray scale reproduction together with high (>2) optical density would be a real step forward in boosting image quality obtained by ink jet printing.

According to the article Continuous Ink Jet Printing of Medical Images of Dr. Philip Drew SCITEX presented on the RSNA Congress, Nov. 1993 in Chicago (Ill.)-U.S.A., with the UniTone ink jet printer (UniTone is a tradename of SCITEX Corporation Ltd.) markedly superior results in gray scale printing, capable of displaying over 100 distinguisable shades of gray, including deep black, in each pixel are obtained, by using two ink jets, one loaded with black colored ink and one with gray colored ink.

3. Objects and Summary of the Invention

It is an object of the present invention to-provide an ink jet printing method having enlarged gray scale reproduction capabilities.

It is a particular object of the present invention to provide an ink jet printing method with enlarged gray scale and high density reproduction capabilities by operating with an ink receiving material having chemical reactivity with respect to at least one ingredient contained in the ink. Therefore said method may be considered as a reactive ink jet printing method.

Other objects and advantages of the present invention will appear from the following description and examples.

In accordance with the present invention an ink jet printing method is provided which method comprises the steps of:

(1) image-wise projecting by means of an ink jet a liquid, called ink, in the form of droplets onto a receiving material containing at least one reagent A that with at least one reagent B contained in the ink droplets is capable of forming by color reaction a colored product, and (2) optionally uniformly heating said receiving material and/or uniformly exposing it to chemically active electromagnetic radiation during and/or after the deposition of said ink on said receiving material to start or enhance said color reaction, characterized in that Onto said receiving material containing said at least one reagent A, either inks of different concentrations of said at least one reagent B are deposited image-wise from separate ink jets, or inks containing reagent A or B are deposited image-wise from separate ink jets, at least one of said inks being deposited from different jets at different concentrations.

Said image-wise deposition of the different inks may be such that droplets of any concentration may be deposited singly, i.e. separately, or at least partly in superposition.

According to a modified embodiment of the ink jet printing method according to the present invention said receiving material is initially free from said reagent A and onto said receiving material one or more inks containing reagent A and one or more inks containing reagent B are deposited image-wise from separate ink jets, at least one of said reagents being deposited from different jets at different concentrations.

The present invention includes the above defined ink jet printing method, wherein dithering and/or error diffusion is (are) applied for improving gray tone reproduction.

The use of a plurality of inks having a different concentration of said color-forming reagent(s) B makes it possible to produce on the receptor material containing said reagent(s) A pixels of different optical density (measured in transmission or reflection depending on the transparency of the ink receiving material) so that the brightness within one halftone cell is not only determinable by altering the number of pixels within said cell (applying dithering) and or droplet-superposition but also by the particular optical density created by each ink droplet that may be colored already on its own.

DETAILED DESCRIPTION OF THE INVENTION

In a particularly practical way for carrying out the present invention the ink jets are produced with a plurality of ink jet printing heads or group of nozzles that are connected to non-communicating ink sources (ink containers or capsules) from which each printing head or group of nozzles is fed with an ink containing a said reagent B in different concentration.

According to an embodiment the printing heads, e.g. four printing heads, or different nozzles are arranged aside in line with regard to a rotating drum carrying the receiving material and are moved on a lead screw to scan the surface of the receiving material.

For example, in monochrome printing according to the present invention said four printing heads or four groups of nozzles are fed with different chemically reactive inks that yield by chemical reaction with the same chemically reactive receiving material optical densities (above the inherent density of the ink receiving material) of 0.01, 0.02, 0.28 and 0.63 respectively. Using such inks less complicated driver circuits for dithering are required and image resolution is maintained for a same gray scale reproduction capability.

According to a particular embodiment different numbers of droplets having same or different concentration of reagent(s) B are applied in superposition, hereby by proper combination reaching a maximum density above 3.00.

According to a preferred mode in the method of the present invention the optical image density formed by the deposited and chemically reactive ink is combined with the optical density of a coloring agent present already in the ink before its deposition on the chemically reactive receiving material. In this connection is mentioned that both the reactants A and/or B may have a color on their own. Operating that way optical densities above 3 in any color can be obtained easily by choice of the reactants A and B optionally in conjunction with colorant(s) present in the reactive ink containing reactant(s) B.

According to a special embodiment the ink has-a color which is complementary to the color formed in the color reaction with the substances A and B. In that way a neutral black image may be formed.

The method of the present invention is especially suited for the production of stable substantially black images of high optical density when said substances A and B represent a chemically reactive system mainly comprising a substantially colorless metal salt and a substantially colorless reducing agent producing therewith a substantially black deposit of finely divided metal in a redox-reaction. The metal image shows excellent archival stability. The metal salt may be an inorganic or organic metal salt.

According to a preferred embodiment the metal salt is a silver salt.

A more detailed description will now be given of the composition and structure of inks and ink receiving materials useful for carrying out the method according to the present invention.

Reactants A and B can be selected from a wide range of color reaction agents for metal ions described by Fritz Feigl in the book "Spot Tests"—Elsevier Publishing Company—New York. (1958).

In that connection are mentioned metal salts providing e.g. iron(III) ions that on complexing with thiocyanate ions (CNS) yield a deep red product or on complexing with 1,2-dihydroxybenzene-3,5-disulfonate form blue, deep violet or red products. With said disulfonate copper and molybdenum salts produce yellow-green and yellow products respectively. Iron (II) gives a green color with 8-hydroxyquinoline- 7-iodo-5-sulfonic acid, and iron (III) salts form with gallic acid black iron gallate.

Further are mentioned stannous sulfate reacting in the presence of triethanolamine with bismuth subnitrate to yield-a black product.

In U.S. Pat. Nos. 3,094,417 and 3,476,578 examples of appropriate thermosensitive combinations of color reactants that are suitable for use according to the present invention are described.

According to an embodiment of the ink jet printing method according to the preceding invention inks containing different amounts of reagent B, Optionally in the presence of different amounts of colorant(s) are each image-wise projected by means of a separate multi-nozzle ink jet printing head onto said receiving material.

According to a special embodiment of the ink jet printing method according to the present invention a said reagent A is applied to said ink receiving material in substantial congruency with ink jet-deposited reagent B from (an) ink jet nozzle(s) not being the same as the ink jet nozzle(s) wherefrom a said reagent B is applied.

According to a preferred embodiment the recording method of the present invention is carried out with an ink-image receiving material containing a substantially light-insensitive silver salt and an ink containing a reducing agent therefor.

Particularly suited substantially light-insensitive silver salts are organic silver salts and more particularly the silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, and likewise silver dodecyl sulphonate described in U.S. Pat. No. 4,504,575 and silver di-( 2-ethylhexyl)-sulfosuccinate described in published European patent application 227 141. Useful modified aliphatic carboxylic acids with a thioether group are described e.g. in GB-P 1,111,492 and other organic silver salts are described in GB-P 1,439,478., e.g. silver benzoate and silver phthalazinone, which may be used likewise to produce a thermally developable silver image. Further are mentioned silver imidazolates and the substantially light-insensitive inorganic or organic silver salt complexes described in U.S. Pat. No. 4,260,677.

The ink for use according to the present invention contains the reactive substance(s) A or B preferably in dissolved form but said substances A or B maybe present in finely dispersed state by which is meant that they are present in the ink in the form of particles of nanometer size, e.g. having a size of 5 to 50 nm in order to avoid nozzle-clogging.

In ink-jet printing according to the present invention colored "water-based", "solvent-based" "mixed water/solvent-based" and "hot melt" or "phase change inks" can be used with the proviso that they contain at least one reagent for another reagent in the ink receiving material to form therein a colored product.

A discussion of the formulation of colored water-based ink-jet inks and preferred properties thereof is given by Henry R. Kang in Journal of Imaging Science, Vol. 35, No. 3, May/June 1991, p. 179–201 and in the "Handbook of Imaging Materials", edited by Arthur S. Diamond—Diamond Research Corporation—Ventura, Calif., printed by Marcel Dekker, Inc. 270 Madison Avenue, New York, N.Y. 10016 (1991), p. 537–540.

Solvent-based inkjet inks, containing a major amount of organic solvent(s), but optionally containing some amount of water, are described e.g. in JP 55160070, JP 63152678, JP 63152679, JP 63152680, JP 61036382 and 61036381. Further are mentioned the low viscosity solvent-based inks described in EP 386349 and the inks described in U.S. Pat. Nos. 4,386,961, 4,400,215, 4,957,553 and 4,822,418. Solvent-based inks with electrostatic deflection properties are described e.g. in JP 61181879. Presently, solvent-based inks contain methyl ethyl ketone, ethanol and methanol as primary solvent (ref. the already mentioned "Handbook of Imaging Material's", edited by Arthur S. Diamond, p. 540).

Solvent-based inks containing a major amount of organic solvent(s) and that are particularly suited for use in thermal inkjet printers (a type of drop-on-demand ink jet printers) are described in detail in published European patent application. 0 413 442. The solvents used have boiling points from about 50° C. to about 200° C. and are e.g. members of the following group: alkyl glycol ethers, wherein the alkyl group has up to 4 carbon atoms, aromatic hydrocarbons, alkyl pyrrolidinones, ketones and lactones. Said ink is particularly suited for printing on a wide variety of plastic films and yields water-fast and smear resistant images.

Hot melt inks for ink jet printing are described e.g. in U.S. Pat. No. 4,659,383, 4,820,346, 4,931,095 and EP 20286, and their properties are discussed in the already mentioned "Handbook of Imaging Materials", edited by Arthur S. Diamond, p. 530.

So, according to One embodiment of the method according to the present invention the Sreagent(s) B is (are) applied to the "ink" receiving recording material from a water-based ink.

As described in the book Imaging Information Storage Technology Edited by Wolfgang Gerhartz—VCH Weinheim—New York—Basel—Cambridge (1992) under the heading "1.13. Ink-jet printing" many of the commercially available ink-jet printers operate with water-base ink (see p. 43 of said book) by which is meant that such inks contain more than 70% by weight of water. Small amounts of humectants such as glycols are added to reduce the evaporation rate and for continuous inkjet printing the ink contains some salt in order to obtain a required electrical conductivity and chargeability for electrostatic droplet deflection. Because of the poor solubility of salt in oil-nonaqueous-base inks the inks for continuous ink jet printing are in practice water-base inks. When operating with a Silver-forming redox system the reducing agent of that system may be Used in salt form and play the role of electrical conductivity increasing ingredient.

Suitable organic reducing agents for the reduction of substantially light-insensitive organic silver salts are organic compounds containing at least one active hydrogen atom linked to O, N or C, such as is the i case in aromatic di, and tri-hydroxy compounds, e.g. hydroquinone and substituted hydroquinones, catechol, pyrogallol, gallic acid and gallates; aminophenols, METOL (tradename), p-phenylenediamines, alkoxynaphthols, acetoacetonitriles, pyrazolidin-3-one type reducing agents, e.g. PHENIDONE (tradename), pyrazolin-5-ones, indanedione-1,3 derivatives, hydroxytetrone acids, hydroxytetronimides, polyhydroxy spiro-bis-indane compounds, reductones, and ascorbic acid. Representatives for thermally activated reduction of organic silver salts are described e.g. in U.S. Pat. Nos. 3,074,809, 3,080,254, 3,094, 417, 3,887,378 and 4,082,901.

The ink used according to the present invention in conjunction with an image-receiving material containing a reducible organic silver salt may contain a mixture of reducing agents, e.g. of (a) primary relatively strong reducing agent, and less active auxiliary reducing agent.

According to an embodiment the ink receiving material contains such auxiliary reducing agent. Sterically hindered phenols as described e.g. in U.S. Pat. No. 4,001,026 are examples of auxiliary reducing agents that can be used in admixture with said organic silver salts without premature reduction reaction and fog-formation at room temperature in the "ink" receiving material used according to the present invention. On heating these auxiliary reducing agents become reactive partners in the reduction of a light-insensitive organic silver salt such as silver behenate.

The silver image density depends on the amount of image-wise deposited reducing agent and the coverage of the substantially non-lightsensitive organic silver salt(s) in the ink-image receiving material. Optionally the optical density obtained by the inherent color of the ink is added to that density.

In order to obtain a neutral black image tone with silver obtained by thermally aided reduction in the higher optical densities and neutral gray in the lower densities the reducible silver salt(s) and reducing agents are used in conjunction with a so-called toning agents known from thermography or photothermography. The toning agent may be present in the ink and/or in the ink receiving material.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446, 648 and 3,844,797. Particularly useful toning agents are likewise the heterocyclic toner compounds of the benzoxazine dione or naphthoxazine dione type within the scope of following general formula:

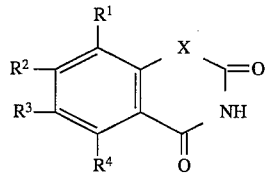

in which:

X represents O or N-alkyl;

each of $R^1$, $R^2$, $R^3$ and $R^4$ (same or different) represents hydrogen, alkyl, e.g. C1–C20 alkyl, preferably C1–C4 alkyl, cycloalkyl, e.g. cyclopentyl or cyclohexyl, alkoxy, preferably methoxy or ethoxy, alkylthio with preferably up to 2 carbon atoms, hydroxy, dialkylamino of which the alkyl groups have preferably up to 2 carbon atoms or halogen, preferably chlorine or bromine; or $R^1$ and $R^2$ or $R^2$ and $R^3$ represent the ring members required to complete a fused aromatic ring, preferably a benzene ring, or $R^3$ and $R^4$ represent the ring members required to complete a fused aromatic aromatic or cyclohexane ring. A very useful toner such as 3,4-dihydro- 2,4-dioxo-1,3,2H-benzoxazine within the scope of said general formula is disclosed in U.S. Pat. No. 3,951,660.

The ink and/or the ink receiving layer may contain other additives such as free fatty acids, surface-active agents, and substances called penetrants improving the take up of the ink in the ink receiving material. Further are mentioned antistatic agents, e.g. non-ionic antistatic agents including a fluorocarbon group as e.g. in $F_3C(CF_2)_6CONH(CH_2CH_2O)$—H.

The ink receiving material may contain other additives, e.g. ultraviolet light absorbing compounds, white light reflecting and/or ultraviolet radiation reflecting pigments, colloidal silica, and/or optical brightening agents.

The ink receiving material contains the reactive substance(s) A preferably in a common film-forming binder. The binder has to be such that a layer is formed into which the reagent(s) contained in the ink can penetrate, optionally by the use of heat.

In a preferred embodiment wherein the ink receiving material contains a substantially light-insensitive silver saltthe binder is preferably a thermoplastic waterinsoluble resin wherein said silver salt can be dispersed homogeneously or form-therewith a solid-state solution. For that purpose all kinds of natural, modified natural or synthetic resins may be used, e.g. cellulose derivatives such as ethylcellulose, cellulose esters, carboxymethylcellulose, starch ethers, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals, e.g. polyvinyl butyral, copolymers of acrylonitrile and acrylamide, polyacrylic acid esters, polymethacrylic acid esters andpolyethylene or mixtures thereof. A particularly suitable ecologically interesting (halogen-free) binder is polyvinyl butyral. Polyvinyl butyral containing some vinyl alcohol units is marketed under the trade name BUTVAR B79 of Monsanto USA.

The weight ratio of binder to organic silver salt is preferably in the range of 0.2 to 6, and the thickness of the recording layer is preferably in the range of 8 to 16 μm.

The imaging layer containing the metal salt, e.g. organic silver salt, may be provided with a top coat improving the acceptance of the ink, wherefrom the reagent(s) B can diffuse into the imaging layer [containing reagent(s) A] by after-treatment, e.g. by heat supplied thereto with a hot body, hot air stream or heat-producing electromagnetic radiation, e.g. infrared radiation.

The above mentioned polymers or mixtures thereof forming the binder may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in solid state at temperatures below 50° C. but becomes on heating above that temperature a plasticizer for the binder of the layer wherein they are incorporated and possibly act then also as a solvent for at least one of the redox-reactants, e.g. the reducing agent for the organic silver salt. Useful for that purpose are a polyethylene glycol having a mean molecular weight in the range of 1,500 to 20,000 described in U.S. Pat. No. 3,347,675. Further are mentioned compounds such as urea, methyl sulfonamide andethylene carbonate being heat solvents described in U.S. Pat. No. 3,667,959, and compounds such as tetrahydro-thiophene-1,1-dioxide, methyl anisate and 1,10-decanediol being described as heat solvents in Research Disclosure, December 1976, (item 15027) pages 26–28. Still other examples of heat solvents have been described in U.S. Pat. Nos. 3,438,776, and 4,740,446, and in published EP-A 0 119 615 and 0 122 512 and DE-A 3 339 810.

Heat-solvents maybe used likewise in the by ink-jet applied ink, especially when they are water-soluble and can act as moistening agent for an organic water-insoluble binder layer wherein an organic silver salt is present. They improve the penetration of the reducing agent in Said layer bringing about a much faster reactive contact with the reducible organic silver salt.

An ink-image receiving layer containing said organic silver salt is commonly coated from an organic solvent containing the binder in dissolved form but may be applied .from aqueous medium from a latex containing a dispersed polymer having some hydrophilic functionality. Polymers with hydrophilic functionality for forming an aqueous polymer dispersion (latex) are described e.g. in U.S. Pat. No. 5,006,451, but serve therein for forming a barrier layer preventing unwanted diffusion of Vanadium pentoxide serving as antistatic agent.

According to a special embodiment the ink receiving material used in the method according to the present invention comprises a heat-developable photosensitive layer comprising a substantially light-insensitive silver salt, an organic reducing agent and a light-sensitive heavy metal compound, preferably light-sensitive silver halide, which upon exposure to activating electromagnetic radiation forms metal nuclei that upon heating of said layer initiate a redox reaction between the light-insensitive silver salt and the reducing agent applied by ink jet. Examples of photothermographic materials containing such photosensitive layer are described in United Kingdom Pat. Specifications 1,110,046, 1,264,532, and 1,354,186, in U.S. Pat. Nos. 3,667,959, 3,708,304, 3,773,512 and 5,158,866, in published EP 0 497 053, 0 509 740 A1 and 0 505 155, and in published JN 2000043, 2173629 and 1309047. Photo-thermographic recording materials are commercially available under the tradename DRY SILVER of 3M Company.

Prior to receiving the ink-jet ink image the photo-thermographic material is uniformly exposed to produce therein the above defined metal nuclei that upon heating activate the redox reaction in which the substantially light-insensitive silver salt is involved for forming a silver metal image.

By the fact that according to a preferred embodiment of the present invention the reductor is applied image-wise by ink-jet no image-stabilization of the image-background area (being free from reductor) is necessary which is a major advantage for obtaining archival storage of the obtained images.

According to a preferred embodiment a water-insoluble binder layer containing a said substantially light-insensitive organic silver salt is over-coated with a hydrophilic colloid or polymer top layer. The applied overcoat layer is capable of rapidly absorbing a water-base ink-jet ink containing a reducing agent as defined above.

After receiving the water-base ink image the receiving material is heated, e.g. in the range of 60° to 120° C. to allow the reducing agent to diffuse into the waterinsoluble binder layer containing the substantially non-lightsensitive silver salt.

The hydrophilic water-soluble binder of the ink receiving layer accepting a reducing agent may be any hydrophilic colloid used in the preparation of photographic silver halide emulsion layers, preferably is a protein-type binding agent such as gelatin, casein, collagen, albumin, or gelatin derivative, e.g. acetylated gelatin. Further suitable water-soluble binding agents are: dextran, gum arabic, zein, agar-agar, arrowroot and pectin, polyvinyl alcohol and poly-N-vinylpyrrolidone.

Said hydrophilic layer may contain finely divided (colloidal) optically transparent inert pigments, such as transparent colloidal silica not masking the formed silver pattern.

The coating of the ink-image receiving layer may proceed by any coating technique e.g. as described in Modern Coating and Drying Technology, edited by Edward D. Cohen and Edgar B. Gutoff, (1992) VCH Publishers Inc. 22i0 East 23rd Street, Suite 9.09 New York, N.Y. 10010, U.S.A.

The support for the ink-image receiving layer used according to the present invention is preferably a thin sheet or weblike carrier material that should be stable preferably at heating temperatures of between 40° and 160° C. For example, the support is made from paper, polyethylene coated paper or transparent resin film, e.g. made of a cellulose ester, e.g. cellulose triacetate, polypropylene, polycarbonate or polyester, e.g. polyethylene terephthalate. The support may be subbed if need be to improve the adherence thereof of the layer containing at least one of said reactive substances A.

After the deposition of the ink image(s).the ink receiving material is preferably subjected to a uniform heat-treatment in the temperature range of 40° to 160° C. The time and temperature required for substantially enhancing the optical density in the inked areas depends largely on the type of reactants A and B, their concentration in the ink and coverage in the ink-receiving material. Using the above defined redox-system of light-insensitive silver salt and organic reducing agent(s) generally a heating time in the range of 3 to 60 seconds at a temperature of about 100° C. is sufficient to obtain a desired optical density increase.

The heat may be supplied by means of a hot body, e.g. hot metal roller, contacting the support of the ink-receiving material or may be supplied in the form of hot air, e.g. in a ventilated drying oven, and/or may be supplied in the form of radiant heat that absorbed in the deposited ink markings which for that purpose may contain an infra-red light absorbing dye or pigment. Radiant heating may proceed with flash lamp, e.g. xenon gas discharge lamp, incandescent infra-red light lamp or by means of laser beam.

The imaging method according to the present invention can be used for both the production of transparencies and reflection type prints. Such means that the support will be transparent or opaque, e.g. the support has a white light reflecting aspect. For example, a paper base is used which may contain white light reflecting pigments, optionally also applied in an interlayer between the recording layer and said base. In case a transparent base is used, said base may be colourless or coloured, e.g. has a blue colour.

In the hard copy field imaging materials have normally a white opaque base, whereas in the medical diagnostic field black-imaged transparencies find wide application in inspection techniques operating with a light box.

The following examples illustrate the present invention. The percentages and ratios are by weight unless otherwise indicated.

EXAMPLE 1

Preparation of ink receiving material

A subbed polyethylene terephthalate support having a thickness of 100 μm was doctor blade-coated from a coating composition containing methyl ethyl ketone as a solvent and the following ingredients so as to obtain thereon after drying the following recording layer containing:

| | |
|---|---|
| silver behenate | 6.50 g/m$^2$ |
| polyvinyl butyral (BUTVAR B79-tradename) | 6.50 g/m$^2$ |
| 3,4-dihydro-2,4-dioxo-1,3,2H-benzoxazine | 0.74 g/m$^2$ |
| BAYSILON Ö1 (tradename) | 25 mg/m$^2$ |

Onto the dried recording layer a hydrophilic water-permeable receptor layer capable of absorbing an aqueous ink was coated from the following coating solution at a temperature of 45° C.:

| | |
|---|---|
| gelatin | 5 g |
| AEROSOL OT (tradename) 1% solution in water | 0.5 ml |
| water | 95 g |

Said solution was doctor-blade coated so as to obtain a layer containing gelatin at a coverage of 5 g/m$^2$ and AEROSOL OT (tradename) at a coverage of 5 mg/m$^2$.

AEROSOL OT is a tradename of American Cyanamid for di-iso.octylsulfosuccinate being an anionic wetting agent.

Preparation of reactive ink 1

To a commercial water-base black ink for PAINTJET (tradename) printer of Hewlett Packard (catalogue Nr. 51606A) are added per 3 g 0.3 g of ethanol and 75 mg of therein dissolved catechol.

The black color of the ink is due to a mixture of sulfonated yellow, magenta and cyan dyes, tetramethylammonium cations are present in conjunction with the anionic sulfonic acid groups. The ink contains about 89% of water and 1,5-pentanediol as organic solvent together with polyethylene oxide type wetting agent and carboxymethyl cellulose as thickener.

Preparation of reactive ink 2

The composition of the ink 2 was the same as for ink 1 with the difference that only 50 mg of catechol was used.

Preparation of reactiive ink 3

The composition of the ink 3 is the same as for ink 1 with the difference that only 25 mg of catechol was used.

Preparation of ink 4 (non-invention)

The composition of the ink 4 was the same as for ink 1 with the difference that no catechol was used.

Ink jet printing

The above defined inks were used for filling an ink-cassette of the MANNESMANN TALLY-printer (tradename) type MT92 (drop-on-demand type ink jet printer).

Modulated by an electronically stored test-pattern "ink jet" printing was carried out onto the above prepared ink image receiving material depositing the different inks in different area of the receiving material.

A first part (part I) of the printed surface was post-heated during 10 seconds by pressing the printed area against an aluminum block internally electrically heated at a temperature of 115° C.

A second part (part II) of the printed surface was left at room temperature (20° C.).

During the heating step the reductor catechol diffuses from the gelatin-containing layer into the recording layer (imaging layer) containing silver behenate and produces therein black silver metal increasing the optical density of the black ink image already obtained in the gelatin layer with the black water-soluble colorant of the applied ink.

The measured minimum densities (Dmin) and maximum densities (Dmax) obtained with the different inks 1, 2, 3 and-4 are listed in the following Table 1. Said optical densities were measured in both of said parts I and I through an ortho filter with a MacBeth TD 904 densitometer.

TABLE 1

| Part | Dmin | Dmax |
|---|---|---|
| Using ink 1 | | |
| I | 0.12 | 3.2 |
| II | 0.12 | 1.0 |
| Using ink 2 | | |
| I | 0.12 | 2.5 |
| II | 0.12 | 1.0 |

TABLE 1-continued

| Part | Dmin | Dmax |
|---|---|---|
| Using ink 3 | | |
| I | 0.12 | 1.8 |
| II | 0.12 | 1.0 |
| Using ink 4 | | |
| I | 0.12 | 1.0 |
| II | 0.12 | 1.0 |

EXAMPLE 2

Preparation of ink receiving material

A subbed polyethylene terephthalate support having a thickness of 100 μm was doctor blade-coated from a coating composition containing methyl ethyl ketone as a solvent and the following ingredients so as to obtain thereon after drying the following ink receiving layer containing:

| | |
|---|---|
| silver behenate | 4.42 g/m$^2$ |
| polyvinyl butyral (BUTVAR B79-tradename) | 4.42 g/m$^2$ |
| 3,4-dihydro-2,4-dioxo-1,3,2H-benzoxazine | 0.34 g/m$^2$ |
| BAYSILON Ö1 (tradename) | 17 mg/m$^2$ |

Preparation of ink 1

In propylene glycol ether the reductor ethyl gallate was dissolved in a concentration of 0.36 g/l.

Preparation of ink 2

In propylene glycol ether the reductor ethyl gallate was dissolved in a concentration of 1.80 g/l.

Preparation of ink 3

In propylene glycol ether the reductor ethyl gallate was dissolved in a concentration of 9.00 g/l.

Preparation of ink 4

In propylene glycol ether the reductor ethyl gallate was dissolved in a concentration of 45.00 g/l.

Ink jet printing

The above defined ink receiving material was attached to a rotatable drum. A drop-on-demand piezoelectrically modulated ink jet head of XAAR Limited, Cambridge, England was used to spray succesively droplets having a diameter of 100 μm of said different inks 1, 2, 3 and 4 in partly overlapping rectangular patterns. The overlap of said patterns was such that droplets were either or not superposed in number and kind of ink as mentioned in the following Table 2. Of each pixel area corresponding with a single or multiple droplet deposit the optical density was measured in transmission through an ortho filter using a MacBeth densitometer TD 904.

Before the density measurement the ink receiving material was heated uniformly as described in Example 1.

TABLE 2

| INK 1 | INK 2 | INK 3 | INK 4 | Optical Density |
|---|---|---|---|---|
| Number of superposed ink droplets | | | | |
| 0 | 0 | 0 | 0 | 0.06 |
| 1 | 0 | 0 | 0 | 0.07 |
| 2 | 0 | 0 | 0 | 0.11 |
| 3 | 0 | 0 | 0 | 0.15 |
| 4 | 0 | 0 | 0 | 0.19 |
| 5 | 0 | 0 | 0 | 0.21 |
| 0 | 1 | 0 | 0 | 0.08 |
| 0 | 2 | 0 | 0 | 0.15 |
| 0 | 3 | 0 | 0 | 0.18 |
| 0 | 4 | 0 | 0 | 0.20 |
| 0 | 5 | 0 | 0 | 0.23 |
| 1 | 1 | 0 | 0 | 0.14 |
| 2 | 2 | 0 | 0 | 0.21 |
| 1 | 0 | 1 | 0 | 0.35 |
| 1 | 0 | 2 | 0 | 0.56 |
| 1 | 0 | 3 | 0 | 0.78 |
| 1 | 0 | 4 | 0 | 1.05 |
| 2 | 0 | 1 | 0 | 0.40 |
| 2 | 0 | 2 | 0 | 0.64 |
| 2 | 0 | 3 | 0 | 0.88 |
| 2 | 0 | 4 | 0 | 1.08 |
| 3 | 0 | 1 | 0 | 0.50 |
| 3 | 0 | 2 | 0 | 0.78 |
| 3 | 0 | 3 | 0 | 1.01 |
| 3 | 0 | 4 | 0 | 1.16 |
| 3 | 0 | 5 | 0 | 1.39 |
| 4 | 0 | 1 | 0 | 0.55 |
| 4 | 0 | 2 | 0 | 0.81 |
| 4 | 0 | 3 | 0 | 1.01 |
| 4 | 0 | 4 | 0 | 1.25 |
| 4 | 0 | 5 | 0 | 1.44 |
| 5 | 0 | 1 | 0 | 0.55 |
| 5 | 0 | 2 | 0 | 0.78 |
| 5 | 0 | 3 | 0 | 1.03 |
| 5 | 0 | 4 | 0 | 1.21 |
| 5 | 0 | 5 | 0 | 1.37 |
| 0 | 1 | 1 | 0 | 0.28 |
| 0 | 1 | 2 | 0 | 0.48 |
| 0 | 1 | 3 | 0 | 0.69 |
| 0 | 1 | 4 | 0 | 0.87 |
| 0 | 2 | 1 | 0 | 0.36 |
| 0 | 2 | 2 | 0 | 0.53 |
| 0 | 2 | 3 | 0 | 0.73 |
| 0 | 2 | 4 | 0 | 1.01 |
| 0 | 3 | 1 | 0 | 0.41 |
| 0 | 3 | 2 | 0 | 0.61 |
| 0 | 3 | 3 | 0 | 0.83 |
| 0 | 3 | 4 | 0 | 1.05 |
| 0 | 3. | 5 | 0 | 1.31 |
| 0 | 4 | 1 | 0 | 0.43 |
| 0 | 4 | 2 | 0 | 0.66 |
| 0 | 4 | 3 | 0 | 0.89 |
| 0 | 4 | 4 | 0 | 1.18 |
| 0 | 4 | 5 | 0 | 1.35 |
| 0 | 5 | 1 | 0 | 0.48 |
| 0 | 5 | 2 | 0 | 0.68 |
| 0 | 5 | 3 | 0 | 0.92 |
| 0 | 5 | 4 | 0 | 1.09 |
| 0 | 5 | 5 | 0 | 1.38 |
| 1 | 1 | 4 | 0 | 1.06 |
| 2 | 2 | 4 | 0 | 1.21 |
| 3 | 3 | 1 | 0 | 0.56 |
| 3 | 3 | 4 | 0 | 1.26 |
| 3 | 3 | 5 | 0 | 1.48 |

TABLE 2-continued

| INK | | | | Optical |
|---|---|---|---|---|
| 1 | 2 | 3 | 4 | Density |
| 4 | 4 | 1 | 0 | 0.59 |
| 4 | 4 | 5 | 0 | 1.60 |
| 5 | 5 | 5 | 0 | 1.65 |
| 0 | 0 | 0 | 1 | 0.69 |
| 0 | 0 | 0 | 2 | 1.18 |
| 0 | 0 | 0 | 3 | 1.70 |
| 0 | 0 | 0 | 4 | 2.22 |
| 0 | 0 | 0 | 5 | 3.09 |

We claim:

1. A printing method which comprises the steps of:

(1) projecting by means of a plurality of jets a plurality of liquids, each containing different concentrations of at least one substantially light-insensitive organic silver salt, in the form of droplets onto a receiving material containing at least one organic reducing agent for said substantially light-insensitive organic silver salt, said liquid droplets with said receiving material thus forming a silver image or potential silver image thereon, and (2) in the event of incomplete silver image formation, carrying out one of the following processes on said receiving material during or after liquid droplet deposition to complete said silver image formation: uniform heating, uniform exposure to chemically active electromagnetic radiation and uniform heating together with uniform exposure to chemically active electromagnetic radiation.

2. Printing method according to claim 1, wherein said substantially light-sensitive organic silver salt is a silver salt of an aliphatic carboxylic acid known as fatty acid, wherein the aliphatic carbon chain of said aliphatic carboxylic acid has at least 12 C-atoms.

3. Printing method according to claim 1, wherein said organic reducing agent is an organic compound containing in its structure two free hydroxy groups (—OH) in ortho- or para-position on a benzene nucleus.

4. Printing method according to claim 1, wherein at least one of said liquids, said receiving material or at least one of said liquids and said receiving material contain(s) an auxiliary reducing agent.

5. Printing method according to claim 1, wherein at least one of said liquids, said receiving material or at least one of said liquids and said receiving material contain(s) a toning agent for obtaining a neutral black tone in higher optical densities and neutral gray tone in lower densities of a silver image obtained by reaction of said substantially light-insensitive organic silver salt with said organic reducing agent.

6. Printing method according to claim 1, wherein said receiving material after image-wise deposition thereon of said liquids is heated to a temperature of between 40° and 160° C.

7. Printing method according to claim 1, wherein in said method dithering and/or error diffusion is applied to improve gray tone uniformity in image areas having a given gray tone.

8. Printing method according to claim 1 comprising in addition to projecting by means of a plurality of jets a plurality of liquids each containing different concentrations of said substantially light-insensitive organic silver salt, projecting by means of one or more jets (a) liquid(s) containing said organic reducing agent.

9. Printing method according to claim 8, wherein said additional liquids projected by said additional jets each contain different concentrations of said organic reducing agent.

10. A printing method which comprises the steps of:

(1) projecting by means of a plurality of jets a plurality of liquids in the form of droplets onto a receiving material containing at least one substantially light-insensitive organic silver salt, each of said plurality of liquids containing different concentrations of at least one organic reducing agent for said silver salt, the said liquid droplets with said receiving material thus forming a silver image or potential silver image thereon, and (2) in the event of incomplete silver image formation, carrying out one of the following processes on said receiving material during or after liquid droplet deposition to complete said silver image formation: uniform heating, uniform exposure to chemically active electromagnetic radiation and uniform heating together with uniform exposure to chemically active electromagnetic radiation.

11. Printing method according to claim 10, wherein said receiving material contains the substantially light-insensitive silver salt in a film-forming binder that is permeable either for said liquids or for said reducing agent in molten or vaporized state.

12. Printing method according to claim 10 comprising in addition to projecting by means of a plurality of jets a plurality of liquids each containing different concentrations of said reducing agent, projecting by means of one or more jets (a) liquid(s) containing a substantially light-insensitive organic silver salt.

13. Printing method according to claim 10, wherein said additional liquids projected by said additional jets each contain different concentrations of said substantially light-insensitive organic silver salt.

14. Printing method according to claim 10, wherein said substantially light-insensitive organic silver salt is a silver salt of an aliphatic carboxylic acid known as fatty acid, wherein the aliphatic carbon chain of said aliphatic carboxylic acid has at least 12 C-atoms.

15. Printing method according to claim 10, wherein said organic reducing agent is an organic compound containing in its structure two free hydroxy groups (—OH) in ortho- or para-position on a benzene nucleus.

16. Printing method according to claim 10, wherein said at least one of said liquids, said receiving material or at least one of said inks and said receiving material contain(s) an auxiliary reducing agent.

17. Printing method according to claim 10, wherein at least one of said liquids, said receiving material or at least one of said liquid and said receiving material contain(s) a toning agent for obtaining a neutral black tone in higher optical densities and neutral gray tone in lower densities of a silver image obtained by reaction of said substantially light-insensitive organic silver salt with said organic reducing agent.

18. Printing method according to claim 10, wherein said receiving material after image-wise deposition thereon of said liquids is heated to a temperature of between 40° and 160° C.

19. Printing method according to claim 10, wherein in said method dithering and/or error diffusion is applied to improve gray tone uniformity in image areas having a given gray tone.

20. A printing method which comprises the steps of:

(1) projecting by means of three or more jets at least three liquids in the form of droplets onto a receiving material, said liquids either containing a substantially light-insensitive organic silver salt or an organic reducing agent therefor, at least one of said liquids containing said substantially light-insensitive organic silver salt and at least one containing said organic reducing agent, the said liquid droplets together thus forming a silver image or potential silver image on said receiving material, and (2) in the event of incomplete silver image formation, carrying out one of the following processes on said receiving material during or after liquid droplet deposition to complete said silver image formation: uniform heating, uniform exposure to chemically active electromagnetic radiation and uniform heating together with uniform exposure to chemically active electromagnetic radiation.

21. Printing method according to claim 20, wherein said liquids containing said substantially light-insensitive silver salt each contain different concentrations thereof.

22. Printing method according to claim 20, wherein said liquids containing said organic reducing agent each contain different concentrations thereof.

23. Printing method according to claim 20, wherein said substantially light-insensitive organic silver salt is a silver salt of an aliphatic carboxylic acid known as fatty acid, wherein the aliphatic carbon chain of said aliphaticcarboxylic acid has at least 12 C-atoms.

24. Printing method according to claim 20, wherein said organic reducing agent is an organic compound containing in its structure two free hydroxy groups (—OH) in ortho- or para-position on a benzene nucleus.

25. Printing method according to claim 20, wherein one or more of said liquids or said receiving material contain(s) an auxiliary reducing agent.

26. Printing method according to claim 20, wherein one or more of said liquids or said receiving material contain(s) a toning agent for obtaining a neutral black tone in higher optical densities and neutral gray tone in lower densities of the silver image obtained by reaction of said substantially light-insensitive organic silver salt with said organic reducing agent.

27. Printing method according to claim 20, wherein said receiving material after image-wise deposition therein of said liquids is heated to a temperature of between 40° and 160° C.

28. Printing method according to claim 20, wherein in said method dithering and/or error diffusion is applied to improve gray tone uniformity in image areas having a given gray tone.

* * * * *